United States Patent [19]

Inaba et al.

[11] 4,328,757

[45] May 11, 1982

[54] THREAD TENSION CONTROL SIGNAL OUTPUT DEVICE FOR SEWING MACHINE

[75] Inventors: Hiroshi Inaba; Kenzi Kato; Tamotsu Nakagawa, all of Hachioji, Japan

[73] Assignee: Janome Sewing Machine Co. Ltd., Tokyo, Japan

[21] Appl. No.: 177,461

[22] Filed: Aug. 11, 1980

[30] Foreign Application Priority Data

Aug. 13, 1979 [JP] Japan ..... 54/102271

[51] Int. Cl.[3] ..... B65H 59/40

[52] U.S. Cl. ..... 112/278

[58] Field of Search ..... 112/278, 273; 242/148; 139/353; 200/61.18

[56] References Cited

U.S. PATENT DOCUMENTS 4,170,951 10/1979 Dobrjanskyj ..... 112/278

4,196,685 4/1980 Tamura ..... 112/273

*Primary Examiner*—Peter P. Nerbun

*Attorney, Agent, or Firm*—Michael J. Striker

[57] ABSTRACT

The invention is to provide an electrical indication of improper thread tension to enable the sewing operation to be exactly accomplished.

6 Claims, 6 Drawing Figures

THREAD TENSION CONTROL SIGNAL OUTPUT DEVICE FOR SEWING MACHINE

BRIEF DESCRIPTION OF THE INVENTION

The invention is to give detecting signals of the thread tension to an electric circuit in which proper relation in tension between an upper thread and a lower thread is present, or set adjustably, in order to issue output signals indicating proper or improper relation therebetween, and to maintain an output for automatic adjustment of the thread tension, or point out the need of the manual adjustment.

Generally, some knowledge is required for determining if or not the thread tension is proper. Even those skilled have difficulties in discerning clearly stitches when the upper and lower are in the same color.

The present invention has been devised to eliminate such disadvantages of the prior art.

A basic object of the invention is to detect the tension of the upper thread and the tension of the lower thread for keeping the tension in proper balance, and compare one thread tension with the other, and, if the tension balance has been lost, give a signal to a control circuit or indicate such condition, so that the tension balance can be amended.

A second object of the invention is to provide favorable and attractive stitches through said detection of the unbalance of the thread tension and by the manual or automatic adjustment of the thread tension.

Many other features or specific effects of the invention will be apparent from the following description of the preferred embodiment of the invention in reference to the attaching drawings.

BRIEF DESCRIPTION OF THE INVENTION

FIGS. 1A, 1B and 1C show an installation of the thread tension device of the invention, FIG. 2 shows a control circuit diagram of the above, and FIGS. 3A and 3B show wave forms of thread tension detecting signals.

DETAILED DESCRIPTION OF THE INVENTION

Figure 1A:
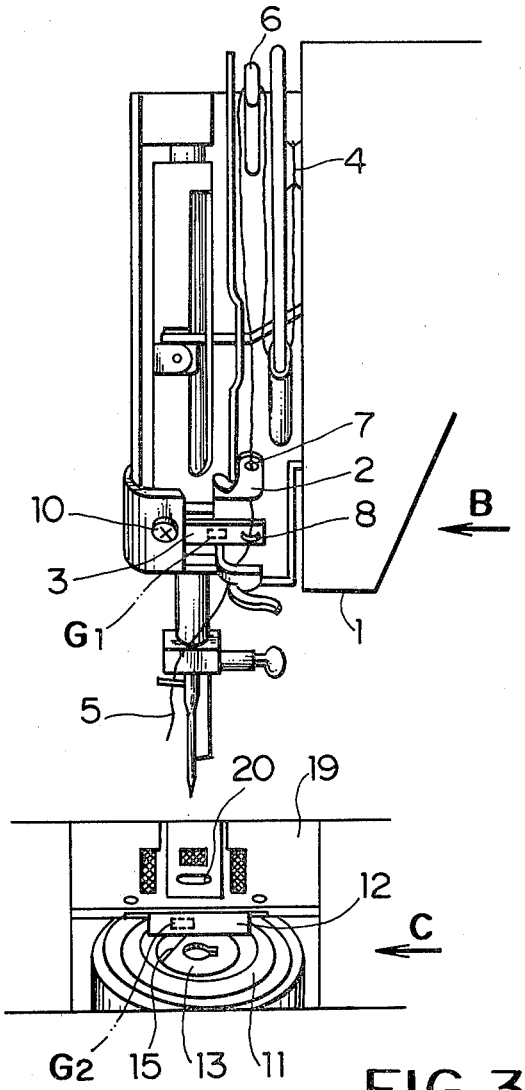
Figure 1B:
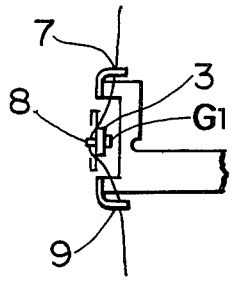
Figure 1C:
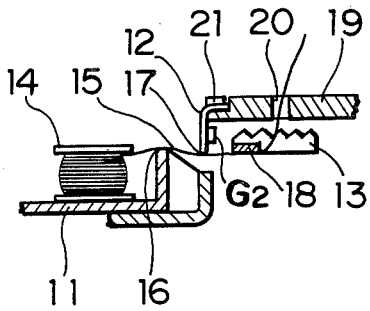

The preferred embodiment of the invention illustrated in the drawings is as follows; FIG. 1 shows an installation of a thread tension detecting device of the invention, and shows in (B) and (C) side views of the principal part of the device viewed from B and C directions. The numeral 1 designates a machine housing. The numeral 2 is a thread guide. 3 shows an elastic member for detecting the tension of the upper thread. Upper thread 5 going through a thread tension adjuster 4 is guided through a takeup lever 6, an upper thread hole 7 of a thread guide 2, a thread loop 8 on elastic member 3, and a lower thread hole 9 of the thread guide 2. The thread loop 8 is biased away from the straight line extending from the thread hole 7 to the other thread hole 9, and when the upper thread 5 is pulled during stitching thread loop 8 displaces a free end of the elastic member 3 whose end is fixed by a screw 10 extending to the right in FIG. 1(B), although not shown there. $G_1$ is a strain gauge attached to elastic member 2 and detecting the upper thread tension to and by detecting the degree of distortion of the elastic member. The numeral 11 is a bobbin carrier of a horizontal race. The numeral 12 is an elastic member detecting the lower thread tension. The numeral 13 is a feed dog and a lower thread 15 supplied from the bobbin 14 is guided to an edge part 16 of the bobbin carrier, and edge part 17 of the elastic member 12 and an arm 18 of the feed dog 13, and passes through a needle hole 20 of the needle plate 19 after going through a needle eye (not shown). The edge part 17 is biased to push the lower thread 15 away from the straight line extending from the edge part 16 to the arm 18. When the lower thread 15 is withdrawn from the bobbin 14 the thread feed regulating member (not shown) in the bobbin carrier 11 tensions the lower thread 15. Pressure proportional to this tension acts on the edge part 17, causing friction (proportional in turn, to this pressure) to act on the edge part 17 and to displace the free end 17. The other end of elastic member 12 is fixed with an unshown screw 21 which actually extends, towards the right in FIG. 1(C). $G_2$ is a strain gauge attached to elastic member 12 for detecting the lower thread tension by detecting distortion of elastic member 12.

Figure 2:
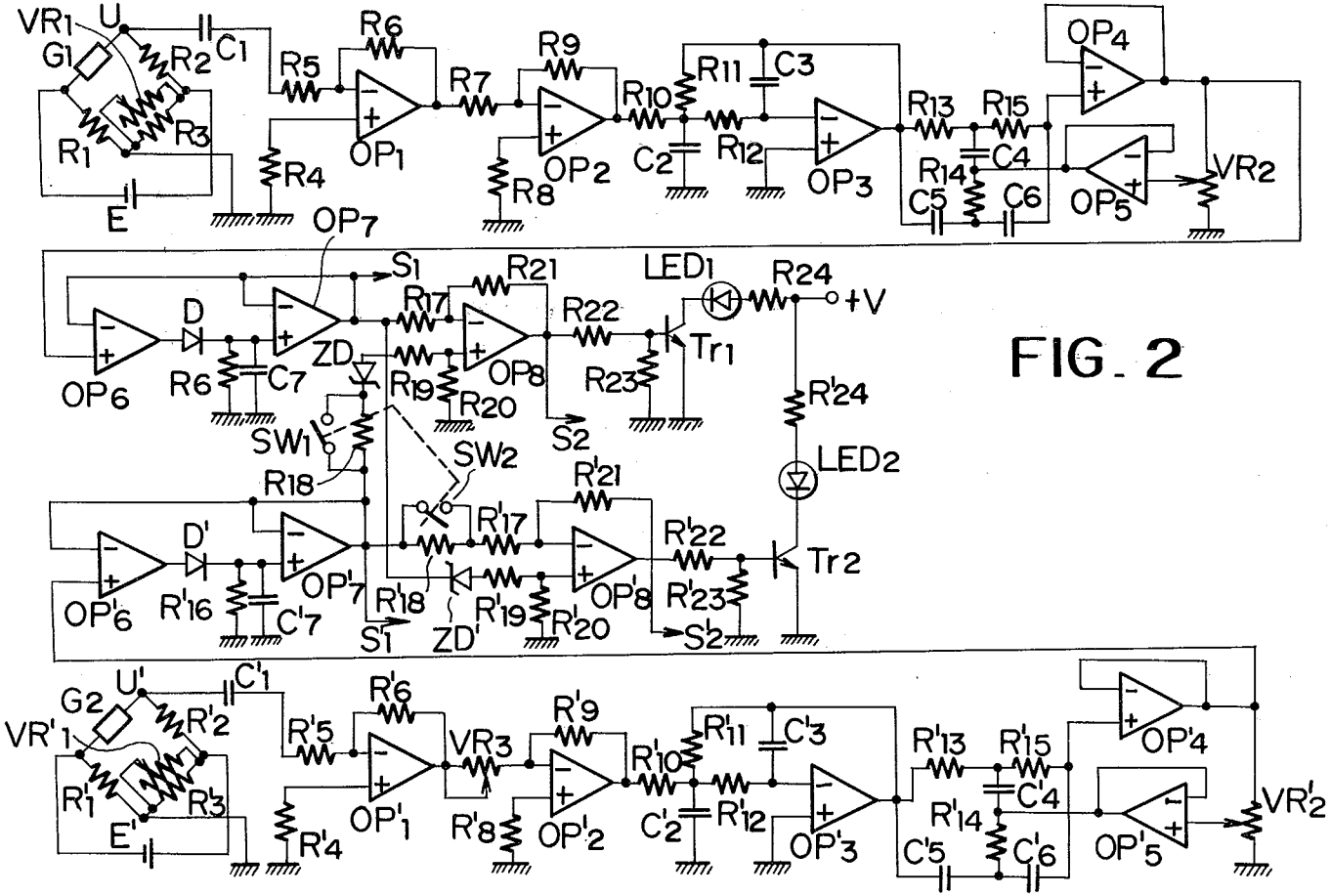

FIG. 2 is a control circuit. The strain gauges $G_1$ and $G_2$ are each connected as a resistance element in a corresponding bridge having DC power source E and E′ respectively to detect the thread tension of the upper thread and the lower thread.

Figure 3A:
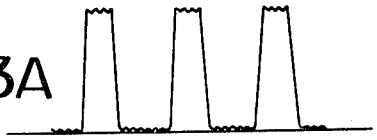
Figure 3B:
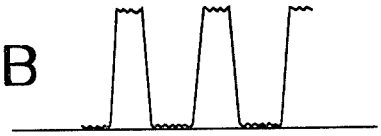

Resistors $R_1$, $R_2$ and $R_3$ constitute a bridge for detecting the upper thread tension and a variable resistance $VR_1$ is preset or adjusted in such a way that when the strain gauge $G_1$ shows 0 distortion, terminal U is at nearly ground potential. The electric potential of a terminal U generates a pulse as shown in FIG. 3(A) (the drawing indicates negative electric potential) per rotation of the sewing machine due to reduction of the resistance of the strain gauge $G_1$ caused by increased tension of the upper thread during sewing. In FIG. 3A the straight line shows 0 electric potential and the time axis. A circuit composed of the operational amplifier $OP_1$, resistance $R_4$, $R_5$ and $R_6$ is a first amplifier which receives the voltage at terminal U at the inverting input terminal of operational amplifier $OP_1$ through the capacitor $C_1$ and the resistance $R_5$. The capacitor $C_1$ is for blocking DC when the adjustment of the variable resistance $VR_1$ is insufficient or DC caused by changes in the temperature in order to automatically adjust and correct distortion which will be brought to 0. A circuit composed of the operational amplifier $OP_2$, resistances $R_7$, $R_3$ and $R_9$ is a second amplifier which receives the output of the operational amplifier $OP_1$ at inverting input terminal of operational amplifier $OP_2$ through a resistance $R_7$ for inverted amplification. A low-pass filter circuit comprising an operational amplifier $OP_3$, resistances $R_{10}$, $R_{11}$ and capacitors $C_2$ and $C_3$ blocks high frequency inductive components caused by outside noises, and its output is inverted. Operational amplifiers $OP_4$, and $OP_5$, resistances $R_{13}$, $R_{14}$ and $R_{15}$, variable resistances $VR_2$ and capacitors $C_4$, $C_5$ and $C_6$ all form a notch filter to cut off induction from commercial AC power sources, and this circuit receives the output from the operational amplifier $OP_3$ and gives outputs from the operational amplifier $OP_4$. The variable resistance $VR_2$ is for tuning and adjusts the cut off frequency of the notch filter. A peak holding circuit comprising an operational amplifier $OP_6$ and $OP_7$, a diode D, a resistance $R_{16}$ and a capacitor $C_7$ charges capacitor $C_7$ and holds the voltage across it until the voltage output from the operational amplifier $OP_6$ reaches the peak value of the voltage whose wave form is nearly equal to that illustrated in FIG. 3(A) and causes the operational amplifier $OP_7$ to output the voltage so held. The structure of the control circuit including low thread tension detecting strain gauge $G_2$, and the function of individual elements therein are almost identical to those of the control circuit including strain gauge $G_1$, and corresponding functional elements are primed. The electric potential at terminal U' generates an identical pulse during sewing, caused by reduced resistance of the strain gauge $G_2$ due to the increased tension of the low thread 15, which pulse is approximately 180° out of phase with the corresponding pulse from the strain gauge $G_1$, as is shown in FIG. 3(B). The amplification is varied with the variable resistance $VR_3$ having an adjustment part outside of the sewing machine. Based on adjustment of variable resistance $VR_3$, the outputs from operational amplifiers $OP_7$ and $OP'_7$ set sensitivity of the strain gauges $G_1$ and $G_2$ be nearly equal adjustment value when the tension balance between the upper thread and the lower thread is proper. The operational amplifier $OP_8$ is a first comparator which receives the output of the operational amplifier $OP_7$ at the inverting input terminal of operational amplifier $OP_8$ via a resistance $R_{17}$, and receives the output of the operational amplifier $OP'_7$ at its non-inverting input terminal of operational amplifier $OP_8$ a resistance $R_{18}$, Zener diode ZD, and resistance $R_{19}$. $R_{20}$ is a voltage-divided resistance, and $R_{21}$ is a feedback resistance, and the operational amplifier $OP_8$ inverts and amplifies the output of the operational amplifier $OP_7$. $Tr_1$ is a first transistor which receives at its base the output of the operational amplifier $OP_8$ via resistance $R_{22}$, and the collector of first transistor $Tr_1$ is connected with a cathode of a luminous diode $LED_1$ (for indicating excessive lower thread tension) which receives the power source (+V). $R_{23}$ is a base-emitter resistance, and $R_{24}$, is a current limiting resistance. The operational amplifier $OP'_8$ is a second comparator which receives the output from operational amplifier $OP_7$ at its non-inverting input terminal of operational amplifier $OP'_8$ via Zener diode ZD', and a resistance $R'_{19}$. $Tr_2$ is a second transistor which receives at its base the output of an operational amplifier $OP'_8$ via the resistance $R'_{22}$ and the collector is connected with the cathode of a luminous diode $LED'_2$ which indicates excessive upper thread tension. The Zener diodes ZD, ZD' are provided with characteristics such that a corresponding luminous diode $LED_1$ or $LED_2$ lights only when the lower thread tension or the upper thread tension is higher than a fixed standard to prevent diodes $LED_1$ and $LED_2$ from always lighting alternately. The banged switches $SW_1$ and $SW_2$ are operable outside of the sewing machine, or are operated by selection of patterns, in order to switch tension balance between the straight stitching and the other pattern stitching. When released, switches $SW_1$ and $SW_2$ prompt lighting of the excessive upper thread tension indicator $LED_2$, and when closed, they prompt lighting of the excessive lower thread tension indicator $LED_1$. In the pattern stitching, it is desirable to have crossing point between the upper thread and the lower thread at a point slightly below the center of the cloth. For this reason, it is desirable to use the switch to reduce the upper thread tension from the tension used in straight stitching. $S_1$, $S_2$, $S'_1$ and $S'_2$ are output terminals which are connected to an automatic adjustment control circuit of the upper thread and the lower thread (or the upper thread only) which is independently provided with an upper thread tension peak hold signal, the excessive lower thread tension signal, the lower thread tension peak hold signal and the upper thread tension signal. When the straight stitch is selected in the above structure, the switches $SW_1$, $SW_2$ are closed. The variable resistance $VR_3$ is set to the standard value. Every time the take-up lever rises on each rotation of the sewing machine, the upper thread 5 is pulled and the resistance of the strain gauge $G_1$ for detecting the upper thread tension is reduced along the curve of the elastic member 3, and a negative pulse is generated at the terminal U as shown in FIG. 3(A). This pulse is amplified via operational amplifiers $OP_1$ to $OP_4$ and $OP_6$, and a peak value of an exactly inverted version of this pulse is held by the capacitor $C_7$. The output which is voltage-followed by the operational amplifier $OP_7$ is given to the inverting input terminal (−) of the operational amplifier $OP_8$, and is also given to the non inverting input terminal (+) of the operational amplifier $OP'_8$. The elastic member 12 is deformed as the lower thread is supplied from the bobbin 14 and the strain gauge $G_2$ detecting the lower thread tension is reduced in the resistance and the terminal U' is generated with negative pulse shown in FIG. 3(B) whose phase is shifted 180° from that shown in FIG. 3(A). This pulse is amplified via the capacitor $C'_1$, and the operational amplifiers $OP'_1$, $OP'_2$, $OP'_3$, $OP'_4$ and $OP'_6$, and the peak value an inverted version of this pulse is held at the capacitor $C'_7$. The voltage-followed output from operational amplifier $OP'_7$ is routed to the non inverting input terminal (+) of the operational amplifier $OP_8$ via the switch $SW_1$, and is also routed to the inverting input terminal (−) of the operational amplifier $OP'_8$ via the switch $SW_2$. If the electric potential of the non inverting input terminal (+) of the operational amplifier $OP_8$ (which is the first comparator) is higher than that of its inverting input terminal, it denotes that the lower thread tension is excessively higher than tension of the upper thread. This causes the output of the operational amplifier $OP_8$ to be positive, thereby turning on transistor $Tr_1$ and causing luminous diode $LED_1$ to light and thus indicate excessive lower thread tension. Normally, in such a case, the holding pressure of the thread adjuster 4 is increased by the manual adjustment. At this time, the electric potential of the non inverting input terminal (+) of the operational amplifier $OP'_8$ (which is the second compactor) is lower than the electric potential of its inverting input terminal (−). The output of the operational amplifier $OP'_8$ is 0, transistor $Tr_2$ remains turned off, and the luminous diode $LED_2$ does not light. If the electric potential of the non inverting input terminal (+) of the operational amplifier $OP'_8$ is higher than that of its inverting input terminal (−), it denotes that the upper thread tension is higher than the lower thread tension, and the output of the operational amplifier $OP'_8$ turns positive, causing the luminous diode $LED_2$ to light, and reducing the holding pressure of the thread tension adjuster 4. When stitches including the needle swinging amplitude such as the pattern stitches are selected, the switches $SW_1$ and $SW_2$ are opened, and the resistances $R_{18}$ and $R_{18}'$ are placed in circuit. Therefore, the excessive upper thread tension indicating luminous diode $LED_2$ lights as the thread tension remains at its previous value (neither of luminous diodes $LED_1$ and $LED_2$ lights in the straight stitch) and an order is given either to reduce the upper thread tension or to increase the lower thread tension. The lower thread tension shown in FIG. 3(B) generally remains almost constant despite changes in the speed of the sewing machine, but the upper thread tension shown in FIG. 3(A) is influenced by the moving characteristic of the takeup lever 6 and its wave value increases as the speed of the sewing machine increases. Even as speed increases, proper thread tension is provided by means of the automatic adjustment control circuits of the upper and lower threads (the upper thread only) which are independently provided by utilizing individual signals outputs $S_1$, $S_2$, $S'_1$ and $S'_2$.

We claim:

1. An electronic thread tension monitor for monitoring upper thread tension and lower thread tension, comprising:

an upper thread tension sensor responding to upper thread tension and generating an upper thread tension signal which is proportional thereto;

a lower thread tension sensor responding to lower thread tension and generating a lower thread tension signal which is proportional thereto;

a first memory connected to the upper thread tension sensor and registering peak values of the upper thread tension signal;

a second memory connected to the lower thread tension sensor and registering peak values of the lower thread tension signal; and a comparator stage connected to the first memory and the second memory and performing a comparison between peak values stored in the first memory and peak values stored in the second memory and generating a tension balance signal as a result of the comparison.

2. The electronic thread tension monitor defined by claim 1, wherein at least a one of the upper thread tension sensor and the lower thread tension sensor includes an elastic member bearing against a thread and being distorted as a result of tension thereof, and wherein a strain gauge is secured to the elastic member to measure such distortion.

3. The electronic thread tension monitor defined by claim 2, wherein the strain gauge has a strain-variable resistance and is connected in a resistance bridge.

4. The electronic thread tension monitor defined by claim 1, further including a first low-pass filter connected between the upper thread tension sensor and the first memory and a second low-pass filter connected between the lower thread tension sensor and the second memory.

5. The electronic thread tension monitor defined by claim 4, further including a first notch filter connected between the first low-pass filter and the first memory and a second notch filter connected between the second low-pass filter and the second memory.

6. The electronic thread tension monitor defined by claim 1, wherein at least one of the first memory and the second memory includes a capacitor which is charged by a corresponding one of the upper thread tension signal and the lower thread tension signal through a diode.

* * * * *